United States Patent [19]

Capes et al.

[11] Patent Number: 4,601,729

[45] Date of Patent: Jul. 22, 1986

[54] AQUEOUS PHASE CONTINUOUS, COAL FUEL SLURRY AND A METHOD OF ITS PRODUCTION

[75] Inventors: Charles E. Capes; Adam J. Bennett, both of Ottawa; Richard D. Coleman, Orleans; William L. Thayer, Ottawa, all of Canada

[73] Assignee: Canadian Patents and Development, Ltd., Ontario, Canada

[21] Appl. No.: 656,675

[22] Filed: Oct. 1, 1984

[30] Foreign Application Priority Data

Oct. 12, 1983 [CA] Canada ..... 438782

[51] Int. Cl.[4] ..... C10L 1/32

[52] U.S. Cl. ..... 44/51; 44/15 R; 44/1 R; 44/53

[58] Field of Search ..... 44/51, 15 R, 1 R, 6, 44/53

[56] References Cited

U.S. PATENT DOCUMENTS

| | | | |
|---|---|---|---|
| 3,268,071 | 8/1966 | Puddington et al. . | |
| 4,187,078 | 2/1980 | Shimizu et al. | 44/51 |
| 4,284,413 | 8/1981 | Capes et al. . | |
| 4,326,855 | 4/1982 | Cottell | 44/51 |
| 4,355,999 | 10/1982 | Masologites | 44/24 |
| 4,389,219 | 6/1983 | Naka et al. | 44/51 |
| 4,392,865 | 7/1983 | Grosse et al. | 44/51 |
| 4,401,437 | 8/1983 | Poetschke | 44/51 |
| 4,437,861 | 3/1984 | Ishizuka et al. | 44/51 |
| 4,441,889 | 4/1984 | Mark | 44/51 |
| 4,478,603 | 10/1984 | Mark | 44/51 |

*Primary Examiner*—William R. Dixon, Jr.
*Assistant Examiner*—Margaret B. Medley
*Attorney, Agent, or Firm*—Murray and Whisenhunt

[57] ABSTRACT

An aqueous phase continuous, fuel slurry is claimed, and its method of production from agglomerates consisting essentially of carbonaceous particles, agglomerating oil and residual water. The slurry may be formed by thoroughly mixing with agglomerates an agglomerate dispersing and coal/oil/water system interfacial tension reducing agent with the agglomerates so that the agglomerates are broken down and an aqueous phase continuous fuel slurry is formed containing residual, oil produced flocs from the agglomerates and having an oil content of the fuel slurry no greater than 10 weight % of the solids content of the fuel slurry. The solids content of the fuel slurry is in the range of the order of 50 weight % and of the order of 80 weight % of the total weight of the fuel slurry, and is preferably in the range of the order of 65 weight % to of the order of 70 weight %. Examples of interfacial tension reducing agents are ethanol, methanol, glycol, butyl alcohol, isopropyl alcohol, lauryl sulfonates, alkyl sulfonates, lignosulfonates, sodium oleate, nonyl-phenolethoxylates, and soaps. With fuel slurries according to the invention, there may be very slow sedimentary consolidation of the carbonaceous particles, but when it does occur there is no difficulty in re-mixing the constituents into a slurry because the residual aggregates or flocs cause the carbonaceous particles to pack down to a porous bed.

3 Claims, No Drawings

AQUEOUS PHASE CONTINUOUS, COAL FUEL SLURRY AND A METHOD OF ITS PRODUCTION

This invention relates to an aqueous phase continuous, fuel slurry and a method of its production.

In conventional coal/water slurries for, for example, transporting coal particles, the presence of oil in the slurry is regarded as undesirable in view of the oleophilic properties of the carbonaceous particles of the coal tending to cause these particles to have an affinity for one another in the presence of oil. This is particularly true when surfactants are added to the coal/water slurry for the purpose of, for example, reducing the viscosity of the slurry because the oil will react with the surfactant and reduce the efficiency of the surfactant.

A process for separating solids by agglomeration is disclosed in U.S. Pat. No. 3,268,071, dated Aug. 23, 1966, I. E. Puddington et al. The process is for the agglomeration and separation of mixtures of two different particulate solids from an aqueous suspendant liquid, one of the solids being hydrophobic and the second one of the solids being hydrophilic to the suspendant liquid. A bridging liquid is added to the mixture in the suspendant liquid, which bridging liquid preferentially wets only the hydrophobic solids to form a film over the wetted hydrophobic solids. The resulting mixture is then subjected to mechanical agitation and turbulent conditions to flocculate the wetted hydrophobic solids and to compact the resulting flocculates into spherical agglomerates. The agglomerates are then separated from the remaining suspension by, for example, screening.

The Puddington et al process has proved to be useful for, for example, the liberation of carbonaceous particles from ash-containing waste fine coal wherein an aqueous suspension of the ash-containing waste fine coal, ground to the ash release particle size, is treated with a light oil agglomerating liquid and agitated to form agglomerates of the carbonaceous coal particles with the light oil, and an ash-containing water phase.

In a more recent U.S. Pat. No. 4,284,413, dated Aug. 18, 1981, C. E. Capes et al, the Puddington et al coal agglomeration process is used in an in-line process to produce a coal-in-oil combustible fuel in this manner. In the Capes et al patent, micro-agglomerates are formed from a coal-in-water slurry using a light oil, the micro-agglomerates are separated from the ash-containing water phase, the separated micro-agglomerates have their water content reduced by forming relatively larger agglomerates therefrom with heavy fuel oil, and coal-in-oil combustible fuel slurry is then formed by mixing the larger agglomerates with make-up heavy oil.

While the Capes et al in-line process has proved to be commercially useful, it would be desirable to form a stable, homogenous, aqueous continuous phase fuel from oil agglomerated coal thus effecting a further saving in oil.

In U.S. Pat. No. 4,187,078, dated Feb. 5, 1980, H. Shimizu et al, a coal dispersing oil is formed as a fuel by adding a dispersing agent in the form of a surface active agent to a petroleum oil, and then mixing the petroleum oil with coal poder, or by adding the surface active agent to the coal powder and then mixing the coal powder with the petroleum oil. Again, while this is undoubtedly useful, in that a saving in oil consumption is achieved, the need still exists for a stable, homogeneous, coal-water fuel containing very little oil, which would effect an even greater saving in the consumption of oil.

According to the present invention, there is provided an aqueous phase continuous, coal fuel slurry, comprising de-ashed, carbonaceous particles, agglomerating oil therefor, water, at least one, coal/oil/water agglomerate dispersing and coal/oil/water system interfacial tensions reducing agent, selected from the group consisting of alcohols and surfactant, and oil bridged flocs of carbonaceous particles for limiting any packing down of the slurry to a porous, easily remixed bed, the slurry containing an oil content no greater than 10 wt.% of the solids content of the slurry, and a solids content in the range of the order of 50 wt.% to of the order of 80 wt.% of the total weight of the slurry.

Further according to the present invention there is provided a method of producing an aqueous phase continuous, coal fuel slurry from agglomerates consisting essentially of de-ashed, carbonaceous particles, agglomerating oil and residual water, comprising, thoroughly mixing with the agglomerates by at least one coal/-water/oil agglomerate dispersing and coal/oil/water system interfacial tension reducing agent selected from the group consisting of alcohols and surfactants and any additional oil and water that may be necessary, so that the agglomerates are broken down and an aqueous phase continuous, fuel slurry is formed containing residual oil bridged flocs from the agglomerates and having an oil content no greater than 10 wt.% of the solids content of the fuel slurry, and a solids content in the range of the order of 50 wt.% to of the order of 80 wt.% of the total weight of the fuel slurry.

Preferably, the fuel slurry formed has a solids content in the range of the order of 65 wt.% to of the order of 70 wt.% of the total weight of the fuel slurry.

The following are details of a number of series of tests that have been carried out to verify the present invention.

The coal used in these tests had the following size specifications:

10 wt.% coarser than 92 μm
50 wt.% coarser than 21.5 μm (median size)
90 wt.% coarser than 5.0 μm.

The coal used was a metallurgical bituminous coal from Cape Breton, Canada, and had an ash content of 3.7 wt.% and sulfur content of about 1 wt.%. It had been ground wet in a mechanical grinder to produce an aqueous starting slurry with about 50 wt.% solids and the above size distribution.

To form the coal agglomerates when these were to be used in making the aqueous phase continuous fuel slurry which is hereinafter referred to as a coal/water/oil (CWO) slurry, the starting slurry was diluted to about 10% solids and mixed in a laboratory blender to form the agglomerates containing the appropriate amount of oil (No. 2 fuel oil in these tests) to produce agglomerates having an oil content no greater than 10 wt.% of the solids content. The agglomerates were recovered on a 100-mesh screen with free ash passing through the screen to waste with excess water. The agglomerates could be dewatered further on a filter if necessary to adjust the water content for the desired CWO slurry composition to have a solids content in the range of the order of 50 to 80 wt.% of the total weight of the CWO slurry composition.

The agglomerates, with water content adjusted, and an agglomerate dispersing and coal/oil/water system interfacial tensions reducing agent, hereinafter referred to as the agent, added to the desired overall composition, were placed in a suitable cylindrical jar and rolled on laboratory rolls, usually overnight, to disperse the agent. Further mixing with a spatula was sometimes necessary to produce a homogeneous final slurry. Vigorous mixing which might degrade the coal particle size was avoided in these laboratory tests.

SERIES 1

A series of CWO slurries was made containing 60 wt.% solids, 1, 2.5 and 5 wt.% No. 2 fuel oil with various levels of a non-ionic surfactant marketed under the trade name Rexol 25/8 by Hart Chemical Ltd., Guelph, Canada, (a nonyl phenol+8 moles ethylene oxide) as the agent. With neither surfactant nor oil present, the viscosity of the suspension was in the range 600–900 mPa-S at a high shear rate, as measured for several samples with a Haake RV100 viscometer. As expected, the CWO slurries generally showed decreasing viscosity as shear rate increased and normally levelled off at an essentially constant value at shear rates above 200 or 300 $sec^{-1}$. These steady values of viscosity are the ones that are given in these series of tests. When this suspension was made with agglomerates so that the overall oil content was 2.5 wt.% and 5.0 wt.%, the mixture was too dry and a non-fluid mixture resulted. When 0.5 wt.% surfactant was added, however, the 2.5 wt.% oil mixture was again fluid with a viscosity of 1150 mPa-S. When 1.0% surfactant was used, both the 2.5 wt.% and the 5.0 wt.% oil mixtures were fluid with viscosities of 205 mPa-S and 186 mPa-S, respectively.

Settling tests in 100 $cm^3$ graduated cylinders at 25° C. showed that slow consolidation of the mixtures took place over several days' tests at a rate of the order of 0.1 mm/h, with the slowest rates at the highest oil loadings.

SERIES 2

A second series of CWO slurries was made containing 64 wt.% solids, 0, 2.5 and 5 wt.% No. 2 fuel oil, again with various levels of the surfactant used in the Series 1. With neither surfactant nor oil present, the suspension had a viscosity of 950 mPa-S at high shear rate measured on the Haake viscometer. When the suspension was made with agglomerates to give an overall oil content of 2.5% and 5.0%, even when 0.5 wt.% surfactant was added, the mixture was too dry and did not form a CWO slurry or, if some thick paste was formed it was interspersed with dry solid lumps. When the CWO slurry was made from the agglomerates of 1% surfactant added, thick homogeneous fluids were formed. Viscosity measured with the Haake instrument at high shear rate was of the order of 800 mPa-S.

Settling tests as in the Series 1 showed that the suspensions consolidated very slowly over several days at rates of the order of 0.03 to 0.04 mm/h. Again, the slowest rates were at the highest oil loadings.

SERIES 3

A third series of CWO slurries was made containing 68 wt.% solids, 0, 2.5 and 5 wt.% of No. 2 fuel oil, and with various levels of the same surfactant used in the above Series 1 and 2. With only coal and water present, an extremely thick non-fluid paste was formed. The same result was found with both levels of oils and 0.5 wt.% of surfactant added. With 1% of surfactant present, in the agglomerated coal suspensions, thick suspensions with viscosities of ca. 1000 mPa-S could be formed with consolidation rates of about 0.01 to 0.02 mm/h in tests using 100 $cm^3$ graduated cylinders.

While the rheology of these mixtures is complex and not completely understood, the tests in the Series 1–3 showed that the retention of some agglomerated coal, in the form of residual aggregates or flocs, still held together by an oil bridging phase, contributed structure and stability to the coal water slurries in that very slow sedimentary consolidation of the carbonaceous particles occurred. Furthermore, where sedimentary consolidation did occur, there was no difficulty in re-mixing the constituents because the residual aggregates or flocs caused the carbonaceous particles to pack down as a porous bed. With higher agglomerated solids contents, this structure normally prevents the formation of CWO fluid fuel slurries. However, even this higher agglomerated solids content structure, and attendant high viscosity and/or solid-like state, may be broken down, according to the present invention, by an agent, such as the surfactant, used to form less viscous fluid fuel slurries of various properties where the viscous behaviour is controlled by the surfactant while stability is contributed by the retention of the oil-bridged structure in the form of residual aggregates or flocs.

It has been found that alcohols can also be used as agents to break down and disperse coal agglomerates to a CWO slurry in the form of a coal liquid mixture (CLM). Alcohols have the added advantage of depressing the freezing point of normal coal-water mixtures which freeze around 0° C., as does water. These points were verified in the following four series of tests using agglomerates recovered from waste fine coal from a coal preparation plant of the Cape Breton Development Corp., Victoria Junction, near Sidney, Nova Scotia, Canada. The agglomerates contained 87.8 wt.% solids, 10 wt.% No. 2 fuel oil and 2.3 wt.% water after air drying overnight on a laboratory bench. The particle size of the coal solids was as follows: 15 wt.% coarser than 28 (Tyler) mesh, 50 wt.% finer than 150 mesh and 40 wt.% finer than 325 mesh.

In each of the following four tests, the mixtures were adjusted by the addition of water so that the coal liquid mixture (CLM) contained 65 wt.% solids and 7.4 wt.% oil, while the balance of 100 wt.% was made up of water and various agents in the form of alcohols and surfactant.

SERIES 4

Agents in the form of methanol (I), isopropyl alcohol (II), and n-butyl alcohol (III) of increasing proportions were added with water (but with no surfactants) to attempt to form SWO slurries with the agglomerates. It was found that about 20% of (II) and (III) had to be added to form a fluid mixture. With (I), even higher amounts were needed to form a rather unsatisfactory, mushy CWO slurry. The CWO slurry did not freeze even at temperatures down to −40° C.

This Series 4 illustrated that alcohols can form non-freezing CWO slurries from agglomerates.

Even lower amounts of an alcohol agent can be used when combined with a surfactant agent, as is illustrated in the following tests.

SERIES 5

A mixture containing 2.6 wt.% of methanol as the agent, and 25 wt.% water (plus the agglomerates) was found to be non-fluid. When 0.5% of the agent identified in Series 1 as the surfactant Rexol 25/8 was added as an additional agent, the mixture became fluid with the consistency of molasses. This mixture was found to freeze at about −4° C.

SERIES 6

A mixture containing 9.6 wt.% of methanol as the agent, 18 wt.% water (plus the agglomerates) was found to be non-fluid. When 0.75% of the agent identified in Series 1 as the surfactant Rexol 25/8 was added, a pasty CWO slurry was formed after mixing. This CWO slurry was found to freeze at −30° to −35° C.

SERIES 7

A mixture containing 2.6 wt.% isopropyl alcohol and 25 wt.% water (plus the agglomerate) was prepared and found to be non-fluid. When 0.5% of the agent identified in Series 1 as the surfactant Rexol 25/8 was added, a thick CWO slurry was formed with a freezing point of about −5° C.

It should be noted that about 1 wt.% of the agent identified as the surfactant Rexol 25/8 would be required to form a CWO slurry with these agglomerates using only water with no agent in the form of alcohol being added. Thus, the alcohol may reinforce the action of the surfactant in forming CWO slurries. The alcohols can be used as agents in various proportions to provide various degrees of freeze protection to the CWO slurries.

Further tests were carried out using various other surfactants to form CWO slurries. These surfactants and their sources are identified in the following Table 1.

The following test was carried out to determine the properties of a CWO slurry according to the present invention.

Two drums of CWO slurries were prepared in the following manner. The moisture content of oil agglomerated waste coal fines from Cape Breton Development Corp., Victoria Junction, Nova Scotia, Canada, was analyzed and found to be 9.3 wt.%. The coal and water feed rates to a Sturtevant mill were adjusted to give a combined feed of approximately 100 pounds per minute and for a CWO slurry comprising 70 wt.% coal and 30 wt.% water. An agent in the form of DREFT was premixed with the coal feed at a level of 0.5 wt.% for the first drum. The two drums were then thoroughly mixed together and passed through the Sturtevant mill a second time to produce the aqueous phase continuous, coal fuel slurry containing oil bridged flocs of carbonaceous particles.

TABLE I

AGENTS USED

| Agent | Agent Group | Agent Description | Chemical Formula of Agent | HLB* of Agent | Agent Obtained From |
|---|---|---|---|---|---|
| Triton X-100 | Non-ionic | Alkylaryl polyether alcohols | 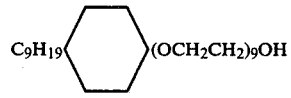 | 13.5 | Rohm Haas Co. |
| Alkasurf NP-6 | Non-ionic | Nonyl phenyl ethoxylate | 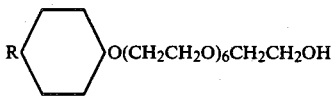 | 11 | Alkaryl Chemicals |
| Alkasurf NP-8 | Non-ionic | Nonyl phenyl ethoxylate | 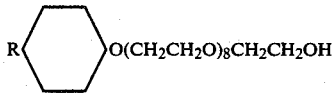 | 12 | Alkaryl Chemicals |
| Alkasurf SS-0-75 | Anionic | Sodium dioctyl sulfosuccinate | $CH_2COOC_8H_{17}$<br>\|<br>$CHCOOC_8H_{17}$<br>\|<br>$SO_3Na$ | — | Alkaryl Chemicals |
| Alkasurf LA-7 | Non-ionic | Alcohol ethoxylates | $R(OCH_2CH_2)_7OH$ | 12 | Alkaryl Chemicals |
| ATLAS G 3300 | Anionic | Alkylaryl sulfonate | — | — | Atkemix Inc. |
| JL-540 | Dispersant | Blend of surfactants | — | — | Atkemix Inc. |
| Red Liquor | Anionic | Lignosulfonate | — | — | Waste from a sulfate pulpmill |
| Oleic acid | Anionic | Sodium Oleate | — | — | Fisher Scientific |

*HLB: Hydrophile-Lipophile balance value range from 0 (oil loving) to 20 (water loving) calculated by dividing the weight percent of ethylene oxide in the surfactant by 5.

The aqueous phase continuous, coal fuel slurry produced in this manner was found to be quite stable and readily pumpable, and no significant settling was observed over a period of five weeks from when the aqueous phase continuous, coal fuel slurry was produced.

The following is a general summary of examples of some agents,

Alcohols: butyl alcohol, ethanol, methanol, glycol, isopropyl alcohol

Surfactants: lauryl sulfonates, alkyl sulfonates, sodium oleate, lignosulfonates, nonyl phenyl ethoxylates, and soaps, or mixtures thereof.

The following are examples of coal sources from which the CWO slurries may be produced, (1) Run-of-mine coal which has been subjected to fine, wet grinding to liberate impurities and then de-ashed by oil agglomeration.

(2) Run-of-mine coal which has been fine, wet ground and de-ashed by oil agglomeration as in (1), but the coal is chemically treated in the fine, wet ground state by, for example, the well known oxidative desulfurization.

(3) Fine coal which has been upgraded and recovered by other means than oil agglomeration, for example, using the well known flotation technique, and then dewatered by oil agglomeration thus avoiding the more costly and slower methods of dewatering such as, for example, filtration.

(4) Fine, waste coals which have been recovered by oil agglomeration.

(5) Oil agglomerates of coal which have been further pulverized to liberate impurities, and then oil agglomerated once again and washed, with or without additional agglomerating oil being added, to reduce the ash content.

(6) Run-of-mine coal which has been fine, wet ground as in (1) and then de-ashed by gravity or by a sedimentary process, and then oil bridged flocs produced from the carbonaceous particles.

We claim:

1. An aqueous phase continuous, coal fuel slurry, containing oil bridged flocs of de-ashed, carbonaceous particles derived from an oil agglomeration thereof and having residual agglomerating oil associated therewith, water, at least one coal/oil/water agglomerate dispersing and coal/oil/water system interfacial tensions reducing agent selected from the group consisting of alcohols and surfactants, wherein said oil bridged flocs function to limit any packing down of the slurry to a porous, easily remixed bed, and wherein the residual oil content of said flocs is no greater than 10 wt.% of the solids content of the slurry, the solids content of the slurry is in the range of the order of 50 wt.% to of the order of 80 wt.% of the total weight of the slurry and the slurry contains at least 0.5 wt.% of said surfactant and/or at least 2.6 wt % of said alcohols.

2. A slurry according to claim 1 wherein the solids content is in the range of the order of 65 wt.% to of the order of 70 wt.% of the total weight of the slurry.

3. A method of producing an aqueous phase continuous, coal fuel slurry fom oil agglomerates consisting essentially of de-ashed, carbonaceous particles, agglomerating oil and residual water, comprising, thoroughly mixing with the agglomerates at least one coal/water-/oil agglomerate dispersing and coal/oil/water system interfacial tensions reducing agent selected from the group consisting of alcohols and surfactants, and water so that the agglomerates are broken down to a slurry containing oil bridged flocs and an aqueous phase continuous, fuel slurry is formed of the resulting oil bridged flocs, and wherein the oil content of said flocs is no greater than 10 wt. % of the solids weight content of the slurry, the solids content of the slurry is in the range of the order of 50 wt. % to of the order of 80 wt. % of the total weight of the slurry and the slurry contains at least 0.5 wt. % of said surfactant and/or at least 2.6 wt. % of said alcohols.

* * * * *